US006416012B1

(12) United States Patent
Wilmoth et al.

(10) Patent No.: US 6,416,012 B1
(45) Date of Patent: Jul. 9, 2002

(54) APPARATUSES AND METHODS FOR CUTTING AND SPOOLING PAPER

(75) Inventors: Bryan N. Wilmoth, Griffin; Bobbie D. Peacock; Robert W. Jones, II, both of Peachtree City, all of GA (US)

(73) Assignee: M.A. Industries, Inc., Peachtree City, GA (US)

( * ) Notice: Subject to any disclaimer, the term of this patent is extended or adjusted under 35 U.S.C. 154(b) by 0 days.

(21) Appl. No.: 09/514,216

(22) Filed: Feb. 25, 2000

Related U.S. Application Data

(60) Provisional application No. 60/121,364, filed on Feb. 25, 1999.

(51) Int. Cl.[7] ..... B65H 35/08; B65H 20/00

(52) U.S. Cl. ..... 242/526.2; 226/166

(58) Field of Search ..... 242/526.2, 527.2, 242/523.1; 226/143, 147, 166

(56) References Cited

U.S. PATENT DOCUMENTS

| | | | | |
|---|---|---|---|---|
| 2,343,047 | A | | 2/1944 | Doyle et al. |
| 2,461,246 | A | | 2/1949 | Weyenberg |
| 2,889,922 | A | | 6/1959 | Clarvoe |
| 3,126,312 | A | | 3/1964 | Nickerson |
| 3,131,843 | A | | 5/1964 | Bentley |
| 3,135,446 | A | | 6/1964 | Sargent |
| 3,406,084 | A | | 10/1968 | Varga |
| 3,421,675 | A | | 1/1969 | Brown et al. |
| 3,497,050 | A | | 2/1970 | Landgraf |
| 3,552,101 | A | | 1/1971 | Papp |
| 3,588,346 | A | | 6/1971 | Ramig, Jr. |
| 3,599,888 | A | | 8/1971 | Coudriet et al. |
| 3,658,628 | A | | 4/1972 | Zenter |
| 3,746,234 | A | | 7/1973 | Mischo et al. |
| 3,765,615 | A | | 10/1973 | Brink et al. |
| 3,836,095 | A | | 9/1974 | Krühn |
| 3,854,642 | A | | 12/1974 | Mueller |
| 3,902,956 | A | | 9/1975 | Thompson, Jr. |
| 3,969,181 | A | | 7/1976 | Seabold |
| 4,004,962 | A | | 1/1977 | Kleid |
| 4,061,527 | A | | 12/1977 | Traise |
| 4,100,681 | A | | 7/1978 | Hollander |
| 4,106,324 | A | * | 8/1978 | Gotz ..... 226/147 |
| 4,177,724 | A | | 12/1979 | Johnson, III et al. |
| 4,264,396 | A | | 4/1981 | Stewart |
| 4,265,176 | A | | 5/1981 | Sato |

(List continued on next page.)

*Primary Examiner*—Michael R. Mansen
(74) *Attorney, Agent, or Firm*—Kilpatrick & Stockton LLP; Michael J. Turton; John S. Pratt

(57) ABSTRACT

Apparatuses and methods are provided for cutting a traveling web of paper that is being spooled on a full spool and transferring the paper web to spool on an empty spool by driving turn-up tape into a nip between the empty spool and the paper web. The apparatuses and methods provide a more problem free way of transferring a traveling paper web to an empty spool. The apparatuses include a drive and a transfer track for transporting the tape beneath the paper web and delivering the tape into the nip, the transfer track including, a horizontal section having a front end and a back end and a first groove running the length of the horizontal section, the first groove being defined by a first top wall, a first side wall, a first bottom wall, and a first flexible seal such that the turn-up tape travels substantially vertical in the direction of travel underneath the paper web, and a turn-up section connected to the back end of the horizontal section, the turn-up section being curved upwardly from the horizontal section to a position adjacent to the empty spool, and the turn-up section having a second groove running the length of the turn-up section, the second groove being defined by a second top wall, a second side wall, a second bottom wall, and a second flexible seal, the turn-up tape traveling substantially perpendicular to the second bottom wall, whereby the drive is capable of driving the turn-up tape to the end of the transfer track. The methods including rotating an equal angle cam in contact with the turn-up tape to move the tape down the transfer track and into the nip.

17 Claims, 14 Drawing Sheets

U.S. PATENT DOCUMENTS 4,293,100 A 10/1981 Sharlow
4,295,916 A 10/1981 Stevens
4,335,858 A 6/1982 Cranna
4,358,979 A 11/1982 Kurzbuch
4,414,258 A 11/1983 Corbin, Sr.
4,582,558 A 4/1986 Antonson
4,605,147 A * 8/1986 Kato ..... 226/147
4,659,029 A 4/1987 Rodriguez
4,661,185 A 4/1987 Kobiella
4,711,404 A * 12/1987 Falk ..... 242/526.2
4,718,971 A 1/1988 Summers
4,757,950 A 7/1988 Rodriguez
4,781,110 A 11/1988 Sakaki et al.
4,783,018 A 11/1988 Rodriguez
4,826,562 A 5/1989 Ehlis
4,869,775 A 9/1989 Quittner
4,938,009 A 7/1990 Takami
4,964,584 A 10/1990 Taipale et al.
5,046,675 A 9/1991 Rodriguez
5,178,717 A 1/1993 Rodriguez
5,277,731 A 1/1994 Krimsky et al.
5,294,407 A 3/1994 Succi et al.
5,338,590 A 8/1994 Rodriguez
5,417,383 A 5/1995 Rodriguez et al.
5,453,141 A 9/1995 Rodriguez
5,456,792 A 10/1995 Rodriguez et al.
5,467,937 A 11/1995 Rodriguez et al.
5,560,180 A 10/1996 Rodriguez et al.
5,637,170 A 6/1997 Rodriguez
5,810,279 A 9/1998 Rodriguez et al.
5,913,489 A 6/1999 Rodriguez et al.
5,954,290 A 9/1999 Rodriguez et al.
6,305,634 B1 * 10/2001 Rodriguez ..... 242/526.2

* cited by examiner

APPARATUSES AND METHODS FOR CUTTING AND SPOOLING PAPER

RELATED APPLICATION

The present application claims priority to and the benefit of the prior filed copending and commonly owned provisional application entitled "Apparatus For Cutting and Spooling Paper," filed in the United States Patent and Trademark Office on Feb. 25, 1999, assigned Application No. 60/121,364, and incorporated herein by reference.

FIELD OF THE INVENTION

The field of this invention is systems related to paper producing and methods of operating the same. More specifically, this invention relates to apparatuses and methods for cutting and spooling a traveling web of paper.

BACKGROUND OF THE INVENTION

Paper is typically produced in wide, continuous sheets. As the sheet is produced, it is wound onto a spool. As each spool is filled it is necessary to transfer the sheet to an empty spool. However, because of the manner in which paper producing machines operate, it is difficult and expensive to shut down the machine while the sheet is cut and transferred to a new spool. Thus, methods for transferring the sheet from a full to an empty spool without interrupting the paper producing machines have been developed. For example, U.S. Pat. No. 4,414,258 to Corbin ("Corbin"), entitled "Turn-up Tape," discloses the manual application of a paper ribbon or "turn-up tape" to a spinning empty spool that is positioned above the moving sheet of paper. The trailing end of the turn-up tape is positioned underneath the sheet. As the turn-up tape is wound onto the spinning empty spool, it cuts across the moving sheet, thereby tearing the sheet and simultaneously holding the cut end of the sheet against the empty spool. In this manner, the sheet is transferred to the empty spool with no interruption or interference with the continuous production of the paper sheet.

Manual application of turn-up tape to empty spools presents certain disadvantages. For instance, the operator responsible for applying the turn-up tape is exposed to dangerous, high-speed equipment. Moreover, manual application is prone to errors in positioning and timing. Thus, machines for applying the turn-up tape to the empty spools have been developed. For example, U.S. Pat. No. 4,659,029 to Rodriguez, entitled "Apparatus and Method for Cutting and Spooling a Web of Paper," discloses a turn-up tape machine having a hand or motor driven tape-feeding mechanism, a tape-cutting mechanism, an open guideway and a brake. The turn-up tape is fed by the tape-feeding mechanism into the guideway. The open guideway travels under the paper sheet and curves up and around so that the exit of the guideway is positioned adjacent to the "nip" or the point where the paper sheet is tangent to the empty spool. The turn-up tape is forced through the guideway and into the nip. When the turn-up tape is pushed into the nip, it sticks to the spool, is pulled out of the guideway and tears the sheet as described above.

In this prior art system, the turn-up tape is pushed through the entire length of the guideway by a roller mechanism located at one end of the guideway and the guideway fits relatively snugly around the turn-up tape to prevent bunching or kinking that would jam the guideway. In other words, this approach is the equivalent of pushing a rope; thus, a close fit is required to keep the "rope" or turn-up tape straight as it is pushed through the guideway. At the same time, however, at least one of the walls, typically the top, of the guideway is open to allow the turn-up tape to be drawn out of the guideway and around the spool. The combination of the open top of the guideway and the close fit between the guideway and the turn-up tape creates additional problems. Moisture and debris can fall into the guideway, damaging the turn-up tape and fouling the guideway, thus creating the kinks and jams the close-fitting guideway is intended to prevent. Covered guideways, such as that disclosed in U.S. Pat. No. 5,467,937 to Rodriguez et al., entitled "Track Assembly For A Cutting Tape," have been used, but the fact that the turn-up tape must be pushed over relatively long distances through a relatively snug channel results in the tape jamming or bunching in the channel.

Also, the configuration of this type of guideway requires that a full twist be placed in the turn-up tape as it travels through the curved portion of the track. This twist not only interferes with the smooth motion of the tape through the track, but also interferes with the extraction of the turn-up tape from the track as it is wound onto the spool.

Other turn-up tape machines have used a shuttle that grips the turn-up tape as it leaves the feed unit and carries it along a track that goes under the sheet and up and around to the nip. The shuttle feeds the free end of the tape into the nip. The turn-up tape, which may hang freely or be draped over extensions protruding from the track, is then drawn up and spooled on the empty spool as described above. This approach resolves the "rope pushing" problem by pulling the tape along its intended path. Nonetheless, the shuttle approach presents other difficulties. For example, the mechanism to motivate the shuttle must take the shuttle through an upwardly curving track—this complex path makes the motivating mechanism complex. Thus, this portion of the track is expensive to manufacture. Moreover, as a result of this complexity, the shuttle may have a tendency to jam in the upwardly curving portion. This portion of the track extends beside and above the traveling web. Thus, to repair or un-jam the shuttle exposes the worker to a dangerous environment. Moreover, this arrangement places the shuttle in close proximity to the nip. Consequently, the shuttle could get drawn into the nip causing severe damage to the turn-up tape machine as well as the paper-making machinery. In addition, this arrangement leaves the turn-up tape exposed to the environment which may allow the turn-up tape to become wet causing it to tear or break when tension is applied, thereby interrupting the cutting process.

Moreover, earlier turn up tape machines typically combined two different devices to deliver the turn-up tape to the nip of the paper machine. For example, a powered drive roller was used to move the tape to the nip by clamping the tape between the powered drive roller and an idler roller. One device, such as an air cylinder, was used to move the two rollers together so as to clamp the turn-up tape. Another device, such as an expensive rotary actuator, was used to power the powered drive roller to move the turn-up tape toward the nip.

SUMMARY

Apparatuses and methods are provided for cutting a traveling web of paper that is being spooled on a full spool and transferring the paper web to spool on an empty spool by driving turn-up tape into a nip between the empty spool and the paper web. The apparatuses and methods provide a more problem free way of transferring a traveling paper web to an empty spool. The apparatuses include a drive and a transfer track for transporting the tape beneath the paper web and delivering the tape into the nip, the transfer track including, a horizontal section having a front end and a back end and a first groove running the length of the horizontal section, the first groove being defined by a first top wall, a first side wall, a first bottom wall, and a first flexible seal such that the turn-up tape travels substantially vertical in the direction of travel underneath the paper web, and a turn-up section connected to the back end of the horizontal section, the turn-up section being curved upwardly from the horizontal section to a position adjacent to the empty spool, and the turn-up section having a second groove running the length of the turn-up section, the second groove being defined by a second top wall, a second side wall, a second bottom wall, and a second flexible seal, the turn-up tape traveling substantially perpendicular to the second bottom wall, whereby the drive is capable of driving the turn-up tape to the end of the transfer track.

The methods including rotating an equal angle cam in contact with the turn-up tape to move the tape down the transfer track and into the nip.

BRIEF DESCRIPTION OF THE DRAWINGS

The accompanying drawings, which are incorporated in and form a part of the specification, illustrate exemplary embodiments of the present invention and, together with the description, disclose the principles of the invention. In the drawings:

FIG. 7 illustrates the mechanics of the equal angle cam;

DETAILED DESCRIPTION

Figure 1:
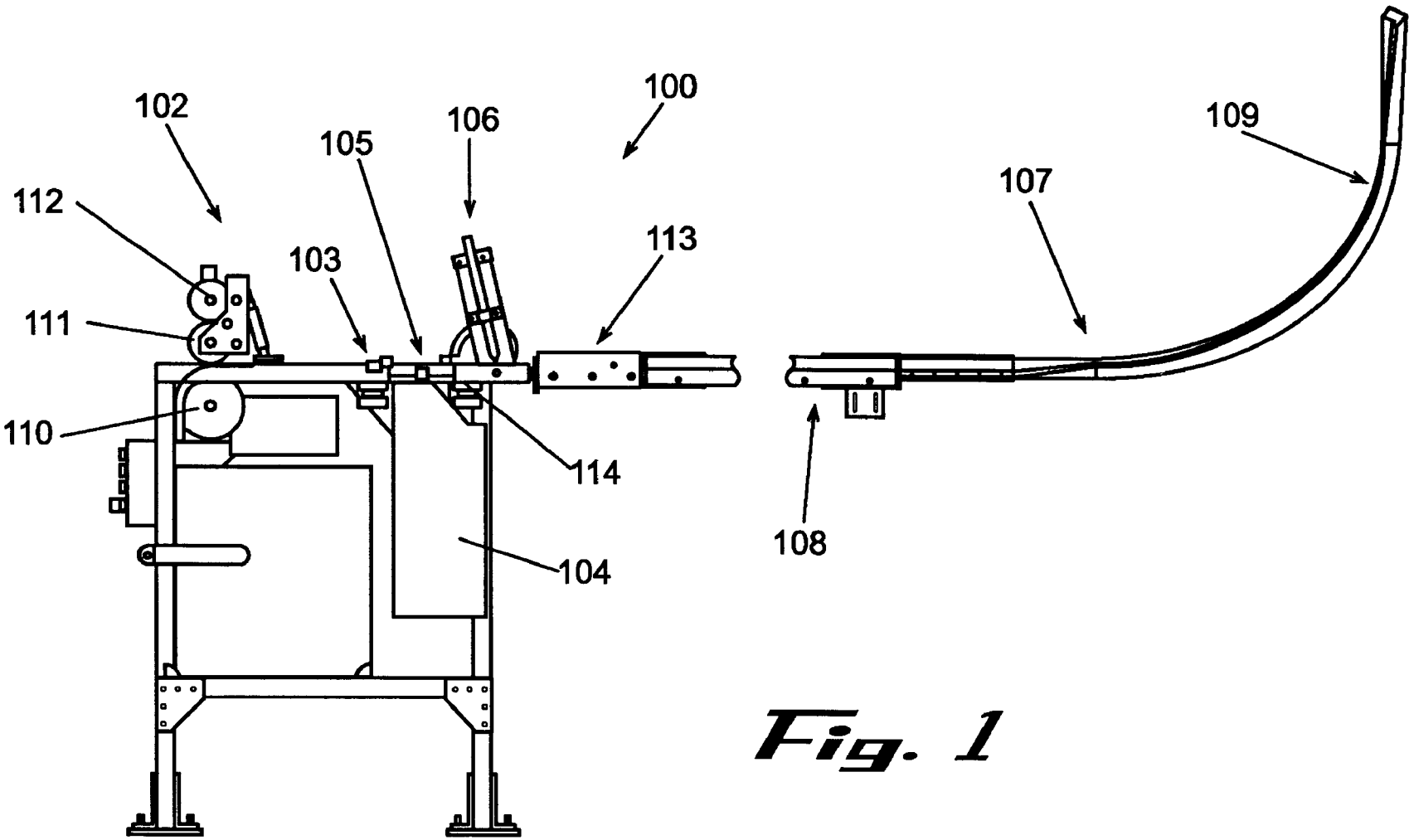
FIG. 1 is an illustration of the turn-up tape machine.

FIGS. 1–20 illustrate an improved turn-up tape machine for spooling and cutting a paper web. Referring to FIG. 1, the turn-up tape machine 100 consists of a conventional drive 102, a cutter assembly 103, a looper bin 104 with a looper bin door assembly 105, a brake assembly 114, a camming unit 106, and a tape transfer track 107 with a horizontal section 108 and a turn-up section 109 and a transition section. The operation of the turn-up tape machine 100 may be controlled automatically by a computer (not shown), manually by an operator activating the appropriate control switches at the appropriate times, or combination of automatically and manually.

Figure 2:
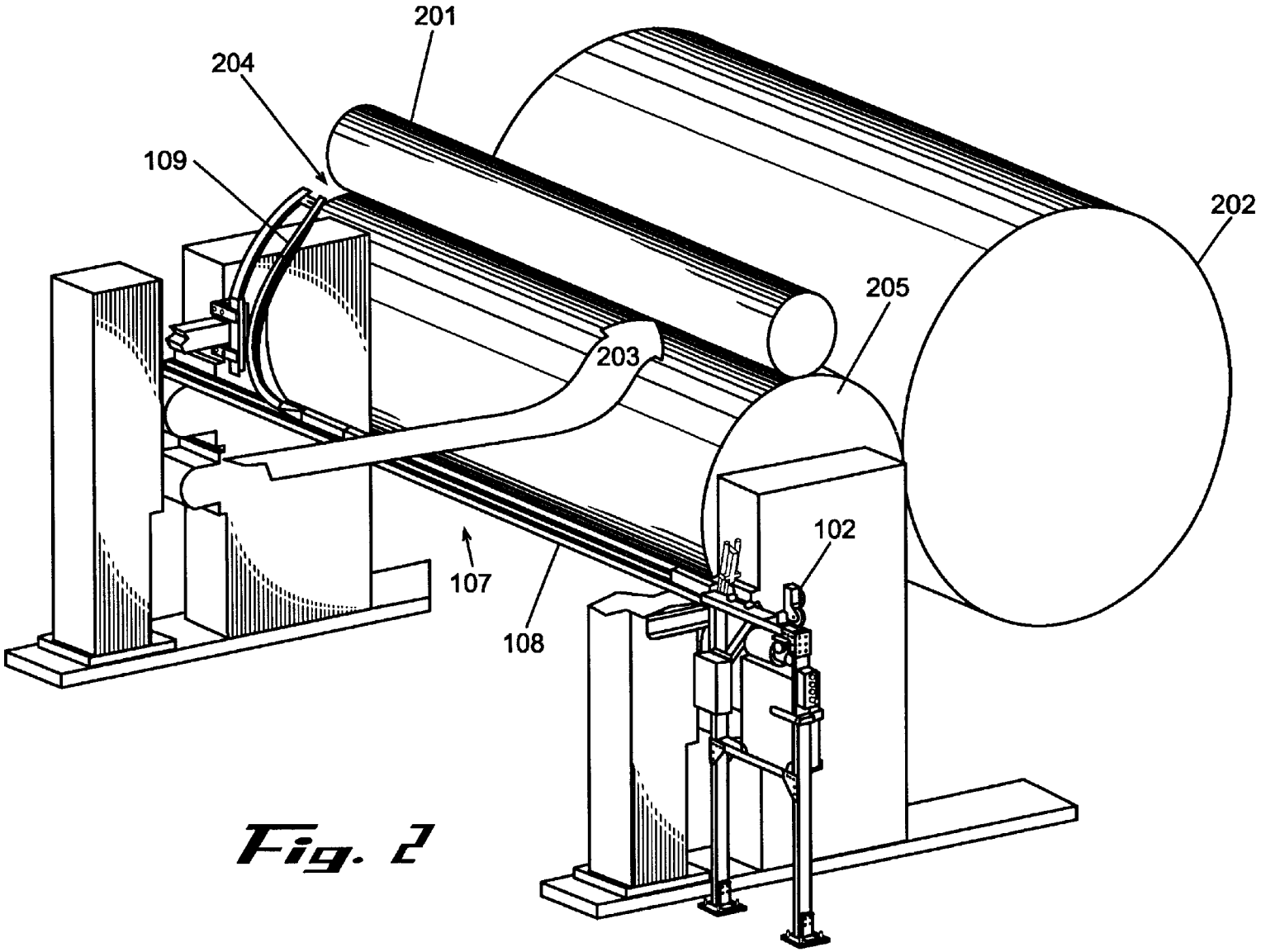
FIG. 2 is an illustration of the turn-up tape machine as it may be placed in use.

FIG. 2 illustrates the turn-up tape machine as it would be positioned in relation to a paper web, a empty spool 201, a reel drum 205, and a full spool 202. The path of the paper web is represented by arrow 203. The paper web is approximately the width of the spools. The turn-up tape machine 100 receives the turn-up tape at the drive 102. Turning back to FIG. 1, the drive 102 moves the turn-up tape along the machine 100 over the looper bin door assembly, through the camming unit, through the horizontal section 108 underneath the paper web and to the end of the turn-up section 109. In one embodiment, adhesive is applied to the forward end of the turn-up tape so that when placed in the nip 204 it sticks to the new spool. This application can be done manually or can be done by a machine. A brake in the brake assembly 114 is then actuated to apply pressure to the turn-up tape. The looper bin door of the looper bin door assembly 105 is then opened. This allows turn-up tape to gather in the looper bin 104. The brake ensures that the tape goes in the looper bin 104 and prevents turn-up tape from passing the looper bin door assembly 105. After an appropriate amount of turn-up tape has collected in the looper bin 104, the cutting assembly 103 cuts the turn-up tape, the brake is released, and the drive turns off. As explained more fully below, the camming unit 106 when signaled at the appropriate time causes the turn-up tape to move into a nip 204 between the empty spool 202 and the paper web (shown in FIG. 2). After operation of the camming unit, the brake of the brake assembly 114 is again actuated to apply pressure to the turn-up tape. The turn-up tape is then wound around the empty spool causing the tape to pull out of the track 107, cut the paper web, and start the paper web spooling on the empty spool.

Turning back to FIG. 1, the conventional drive 102 receives turn-up tape between a lower powered drive roller 110 and an upper idler roller 111 and forces the tape along the turn-up tape machine 100 as explained above. The top roller of the conventional drive 102 is a measurement roller 112 that measures the amount of turn-up tape currently being fed through the turn-up tape machine 100 by tracking revolutions of the idler roller 111 and provides the computer with this information.

Figure 3:
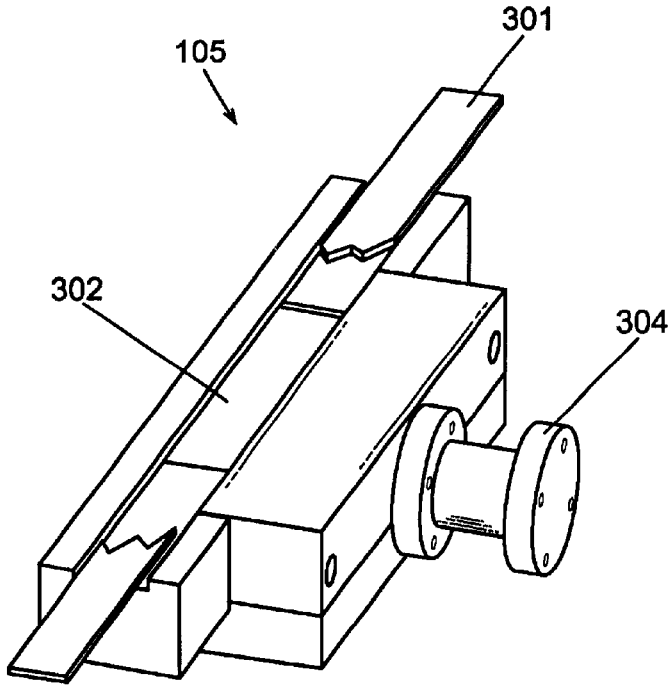
FIG. 3 is an isometric view of the looper bin door assembly.
Figure 4:
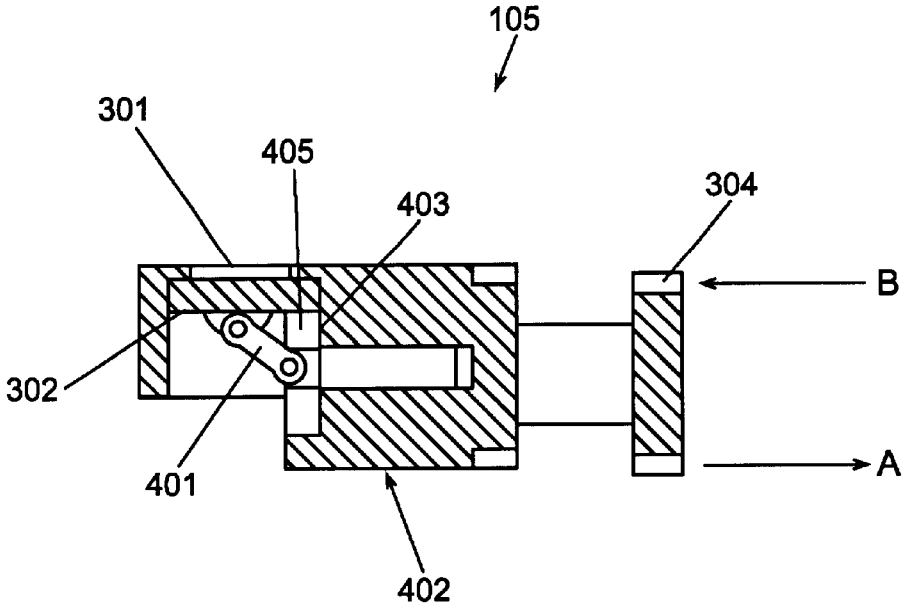
FIG. 4 is a sectional side view of the looper bin door assembly.

Once the end of the turn-up tape has been fed through the tape transfer track 107 to the end of the turn-up portion 109, the computer signals a looper bin door of the looper bin door assembly 105 to open. Additional tape then collects in the looper bin 104. This provides for additional length of turn-up tape to allow for the rotation of the empty spool as it draws the turn-up tape around itself and the paper web. FIGS. 3 and 4 provide a more detailed illustration of the looper bin door assembly 105. Turning to FIG. 4, a looper bin door 302 hinged in a cylinder mount 402 is opened and closed via an air cylinder 304. With the looper bin door 302 closed, the turn-up tape travels freely over the looper bin door 302. The looper bin door 302 is connected to a door attachment link 401 which is connected to an air cylinder rod 403. The air cylinder rod 403 is moved by the air cylinder 304. When the air cylinder rod 403 is moved in direction A by the air cylinder 304 the looper bin door 304 is pulled down and in direction A such that it comes to rest in a notch 405 in a cylinder mount 402. When the looper bin door is opened the turn-up tape 301 falls into the looper bin 104. When the air cylinder rod 403 is moved in direction B by the air cylinder 304 the looper bin door 302 is closed. Turning again to FIG. 1, once an appropriate amount of turn-up tape has passed through the drive 102 and has collected in the looper bin 104, as determined by the measurement roller 112, the computer signals a solenoid driven cutting blade that is part of the cutting assembly 103 to cut the turn-up tape.

Figure 5:
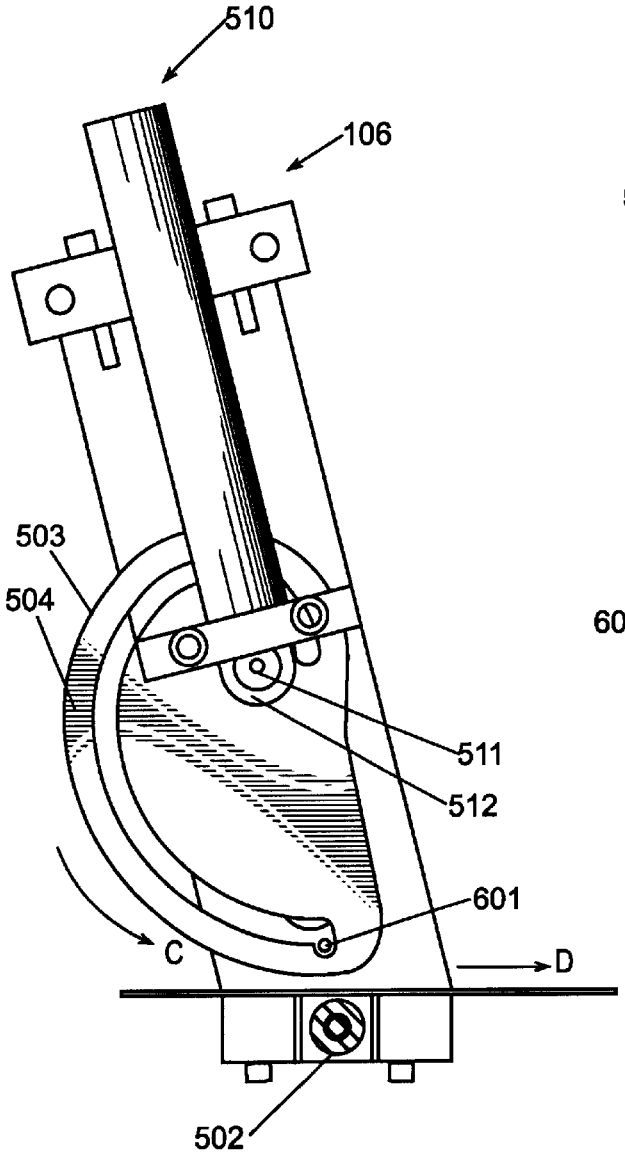
FIG. 5 is a sectional side view of one embodiment of the camming unit.
Figure 6:
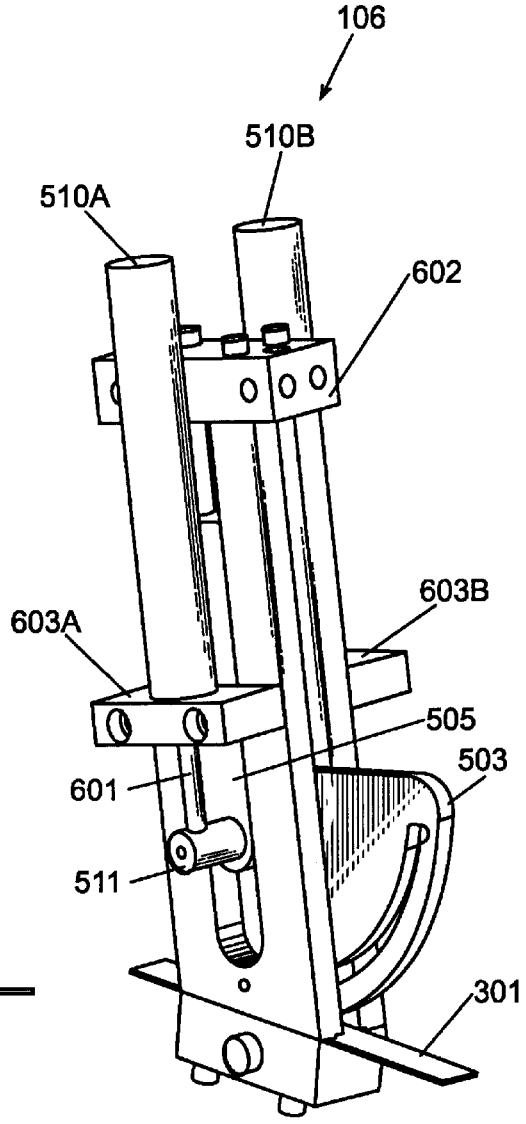
FIG. 6 is an isometric view of one embodiment of the camming unit.
Figure 1:
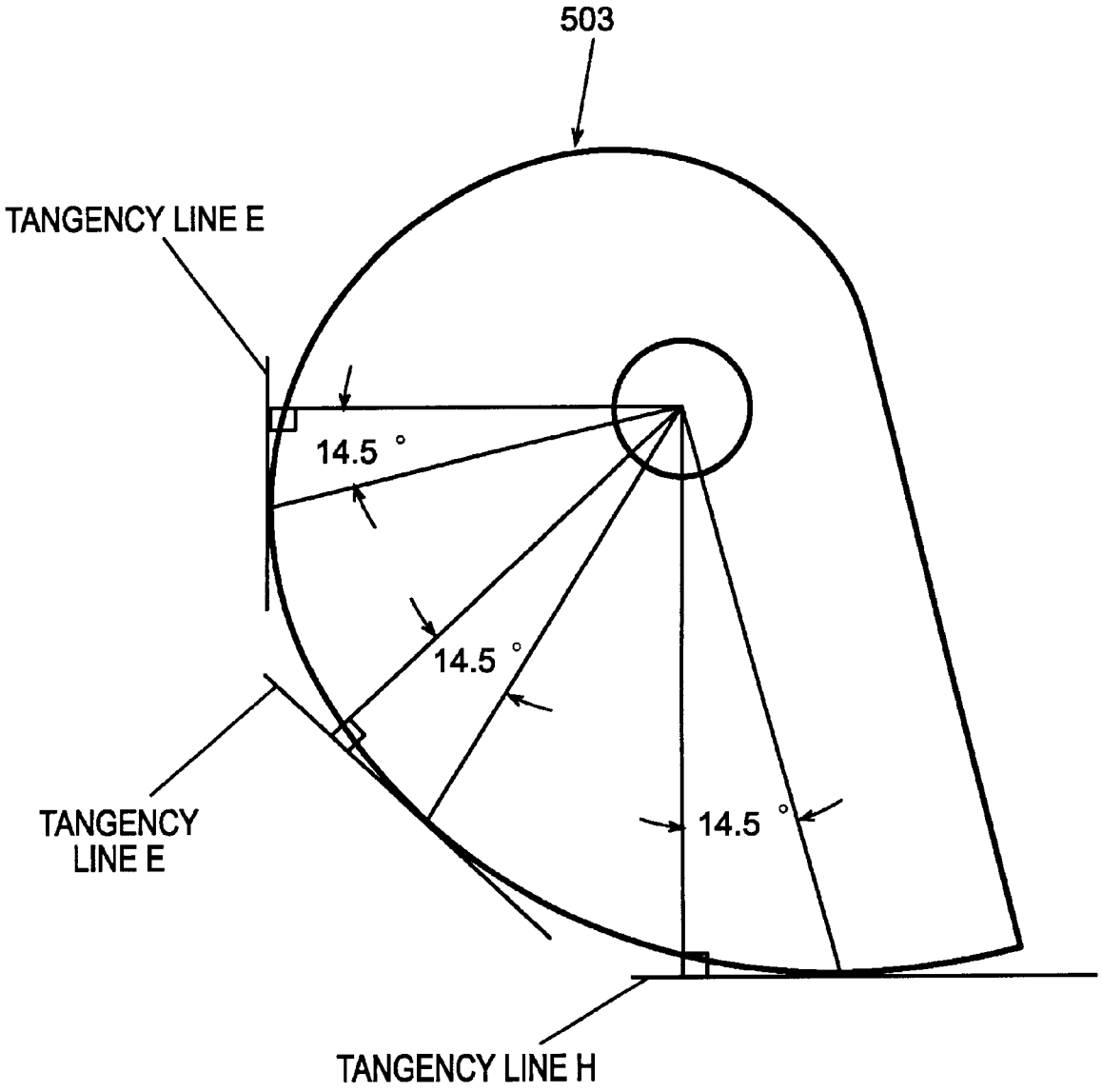

The turn-up tape machine 100 utilizes the camming unit 106 to move the tape at a rapid speed from the end of the turn-up portion 109 of the track into the nip 204. FIGS. 5 and 6 provide a more detailed description of one embodiment of the camming unit 106. Turning now to FIG. 6, the camming unit 106 contains two actuators 510A and B that are attached to a camming unit frame 602 by two blocks 603A and B. Each actuator contain a piston (not shown) and a piston rod 601. Looking by example at actuator 510A, the piston rod 601 goes through the bottom of the actuator 510A and through the block 603A and is attached to a shaft 511. The shaft 511 is connected to two arms of a clevis 505 and is rotatably connected to an equal angle cam 503. The clevis 505 assists in keeping the equal angle cam 503 aligned in the correct position. FIG. 5 illustrates the camming unit at its start position and FIG. 6 illustrates the camming unit approximately halfway through the rotation of the equal angle cam 503.

As shown in FIG. 5, the turn-up tape 301 is positioned between the equal angle cam 503 and a roller 502. When the appropriate amount of turn-up tape has accumulated in the looper bin and it is desired to change spools the camming unit 106 is signaled to actuate the actuators 510A and B which move the pistons and the piston rods 601 in a downward direction. This causes the shaft 511 and the equal angle cam 503 to move toward the roller 502 and the turn-up tape 301 to be clamped between the roller 502 and the equal angle cam 503. As the pistons move down, the equal angle cam 503 rotates and moves in direction C. This moves the turn-up tape 301 down the tape transfer track 107 in direction D. The turn-up tape 301 is moved down the tape transfer track 107 in the direction D by the length of the equal angle cam's 503 circumference. The groove 504 and pin 601 of the equal angle cam 503 assist in positioning the cam 503 before actuation and assist in repositioning the cam 503 upon its retraction.

Figure 21:
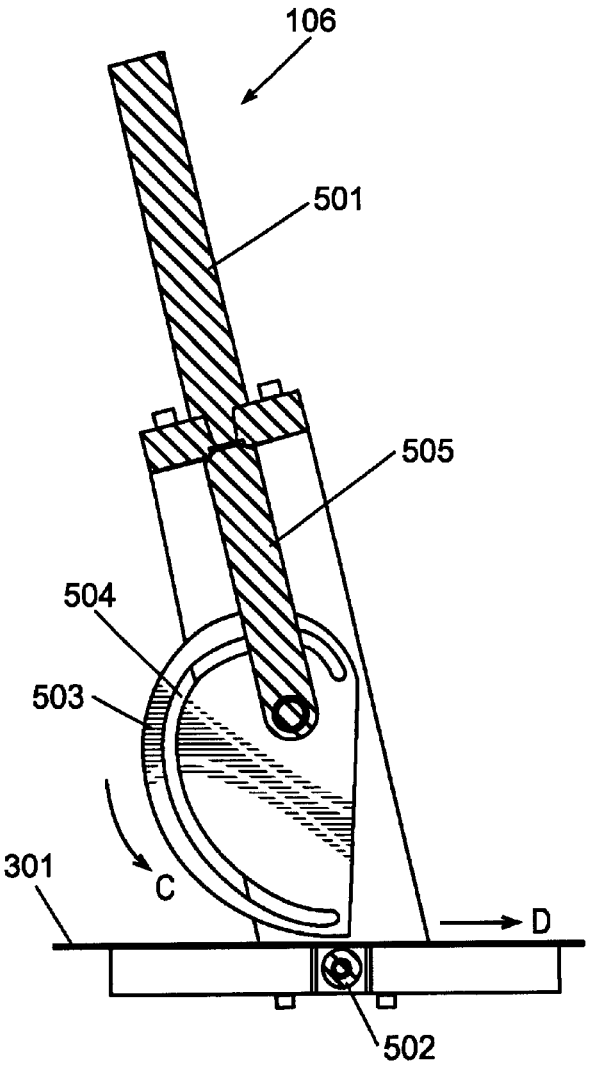
FIG. 21 is a sectional side view of another embodiment of the camming unit.
Figure 22:
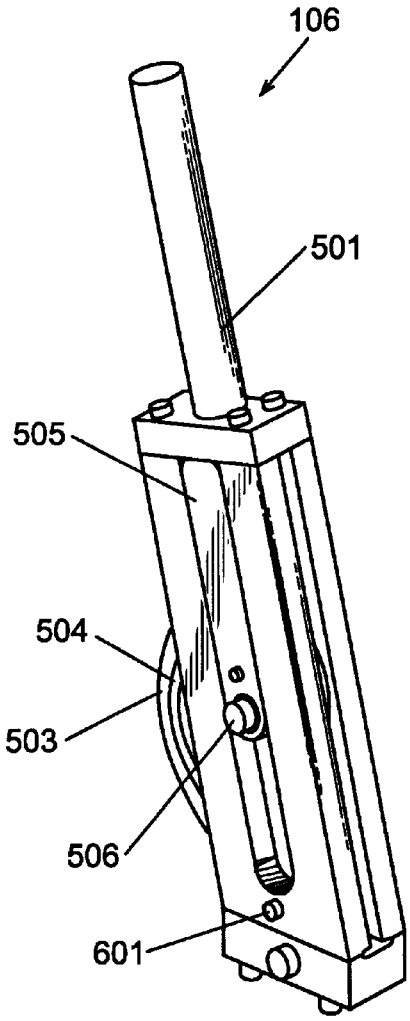
FIG. 22 is an isometric view of another embodiment of the camming unit.

A second embodiment of the camming unit is shown is FIGS. 21 and 22. Turning to FIG. 21, the camming unit includes an actuator 501 that contains a piston and a piston rod (not shown). The piston rod is attached to a clevis 505. The clevis has two arms and the arms are rotatably connected to an equal angle cam 503 by a pin 506. The turn-up tape 301 is positioned between the equal angle cam 504 and a roller 502. When the appropriate amount of turn-up tape has accumulated in the looper bin and it is desired to change spools, the camming unit is signaled to actuate the actuator 501 which moves the piston in a downward direction. This causes the clevis 505 and the equal angle cam 503 to move toward the roller 502 and the turn-up tape 301 to be clamped between the roller 502 and the equal angle cam 503. As the piston moves down, the equal angle cam rotates and moves in direction C. This moves the turn-up tape down the tape transfer track 107 in direction D. The turn-up tape 301 is moved down the tape transfer track 107 by the length of the equal angle cam's 503 circumference. The groove 504 and pin 601 (shown in FIG. 22) of the equal angle cam 503 assist in positioning the cam 503 before actuation and assist in repositioning the cam 503 upon its retraction. While two embodiments of the camming unit are shown, it will be appreciated by one skilled in the art that a variety of techniques exist to move and rotate the equal angle cam.

FIG. 7 further illustrates the mechanics of the equal angle cam 503. In mathematical terms the shape of the cam 503 is known as a logarithmic spiral or equal angle spiral. As such, at any point on the spiral that a tangential line is placed, this line will maintain the same angular relationship with the origin of the spiral. For example, FIG. 7 shows three different tangential lines, E, F, and G. All tangential lines maintain the same angular relationships to the origin of the spiral. In the two embodiments discussed above, the spiral has a 14.5 degree angle as shown by vector H in FIG. 8, but one skilled in the art would appreciate that a spiral with a variety of angles could be used. The design of the equal angle cam insures that as the cam is forced down onto the turn-up tape and the cam 503 rotates, the critical force being applied by the cam to the turn-up tape 301 is consistent as the cam 503 rotates. The formula for a logarithmic spiral is provided below.

$$R = e^{aq}$$

$R$ = the radius of the curve $e$ = the natural log (2.718)

$a$ = the sine of the camming angle $q$ = the angle of the radius in radians

Figure 8:
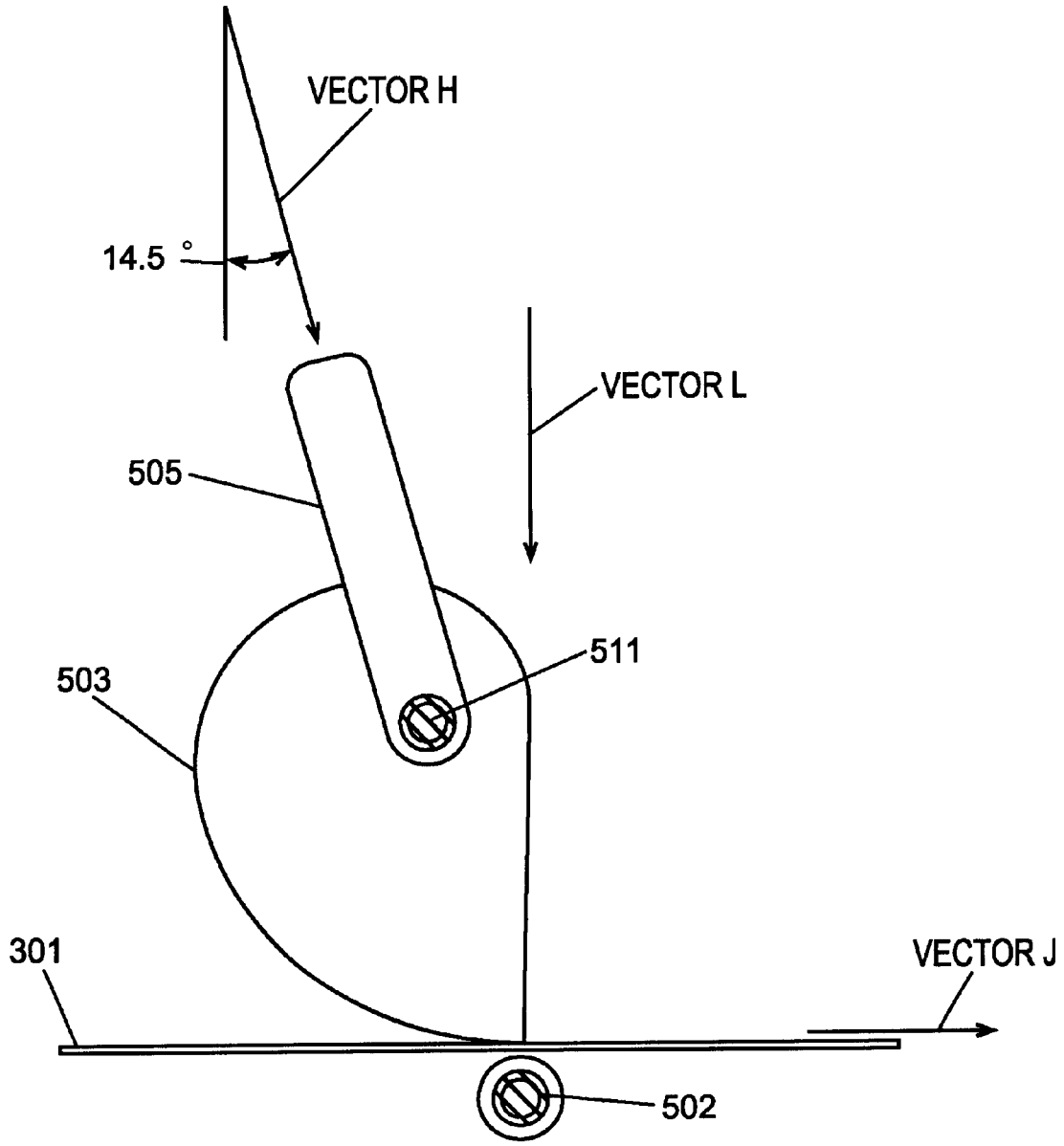
FIG. 8 illustrates the critical force properties associated with the equal angle cam.

FIG. 8 further illustrates the critical force properties that govern operation of the equal angle cam 503. The single camming unit 106 performs both the clamping and pushing operations typically performed by two different devices in prior art turn-up tape machines. As shown in FIG. 8, Vector H is the vector along which the clevis 505 and shaft 511 travel when the camming unit 106 is operating. Vector H is at an angle of 14.5 degrees from a line perpendicular to the turn-up tape 301. In one embodiment, the shaft 511 is driven down along vector H by the actuators. The actuator or actuators supply force in the direction represented by vector H. As force is transferred to the turn-up tape 301 via the cam 503, the force is distributed in the form of a horizontal component, vector I, and a vertical component, vector J. The vertical component, vector J, will provide the majority of the force. This vertical force is responsible for clamping the turn-up tape 301 between the cam 503 and the roller 502 and thus, preventing the turn-up tape 302 from traveling in the wrong direction. The horizontal force provided by the horizontal component, vector J, is responsible for producing the lateral movement that pushes the turn-up tape 301 toward the nip.

When the equal angle cam has finished its rotation, the brake assembly 114 (shown in FIG. 1) is signaled to actuate the brake. The brake applies pressure to the turn-up tape to hold the end of the turn-up tape in place. The brake applies enough pressure on the turn-up tape so that as the turn-up tape begins winding around the empty spool 201 it causes the rest of the turn-up tape to be pulled out of the transfer track 107 and cut through the paper web. The brake applies controlled pressure to the turn-up tape so that it allows the turn-up tape that is in the looper bin slide to past and wind around the empty spool. The end of the turn-up tape then pulls out of the brake assembly 114 and continues to wind around the empty roller 201.

Figure 10:
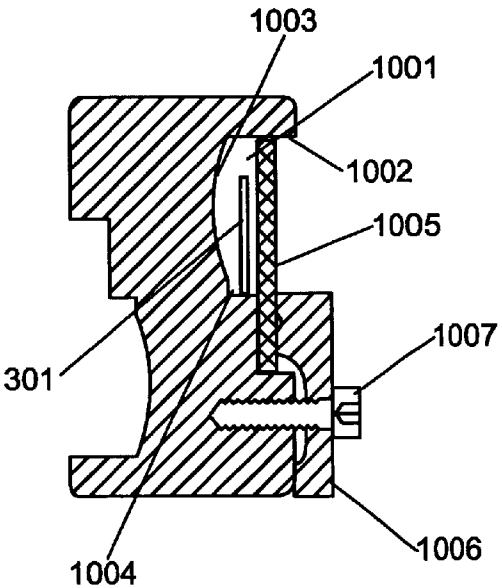
FIG. 10 illustrates a side view of the horizontal section of the transfer track.
Figure 9:
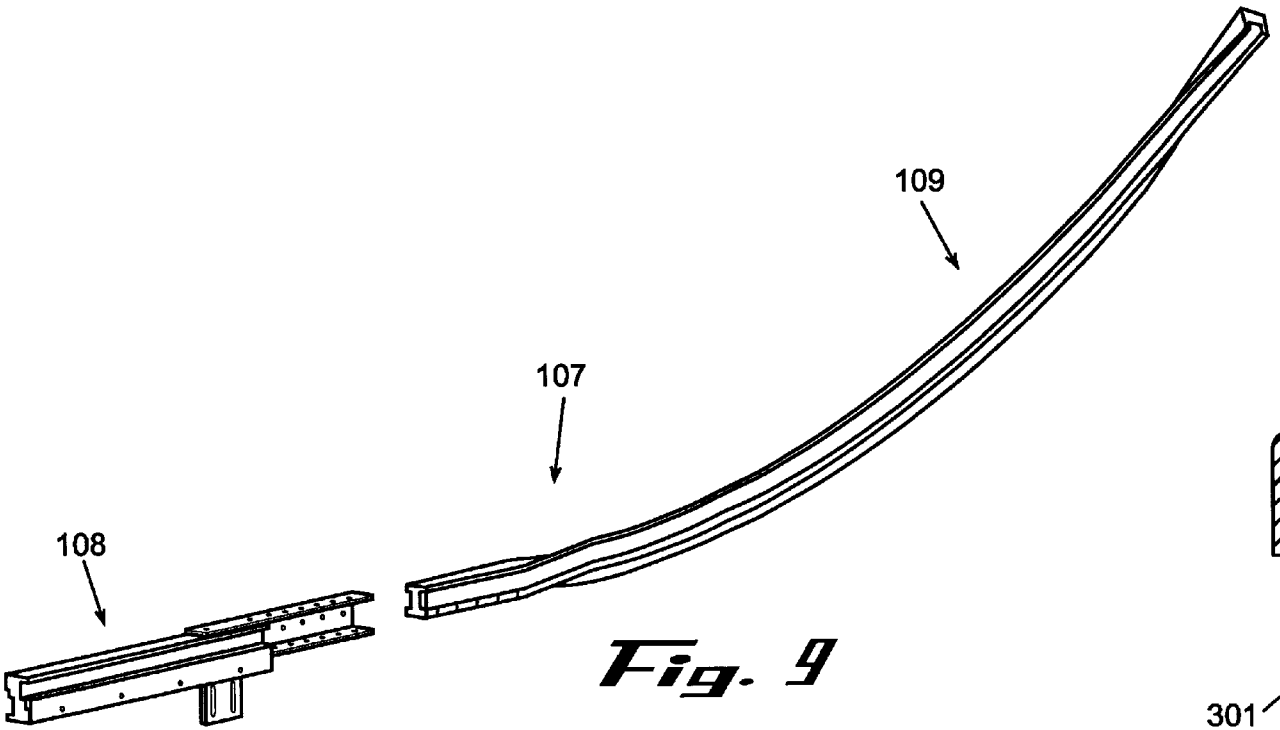
FIG. 9 illustrates one embodiment of the transfer track assembly.
Figure 11:
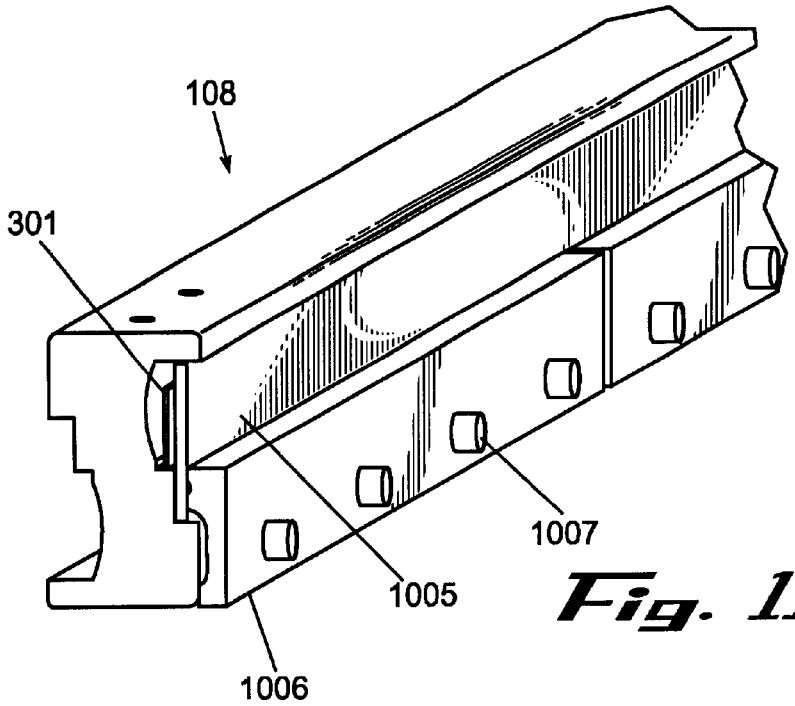
FIG. 11 illustrates an isometric view of the horizontal section of the transfer track.
Figure 12:
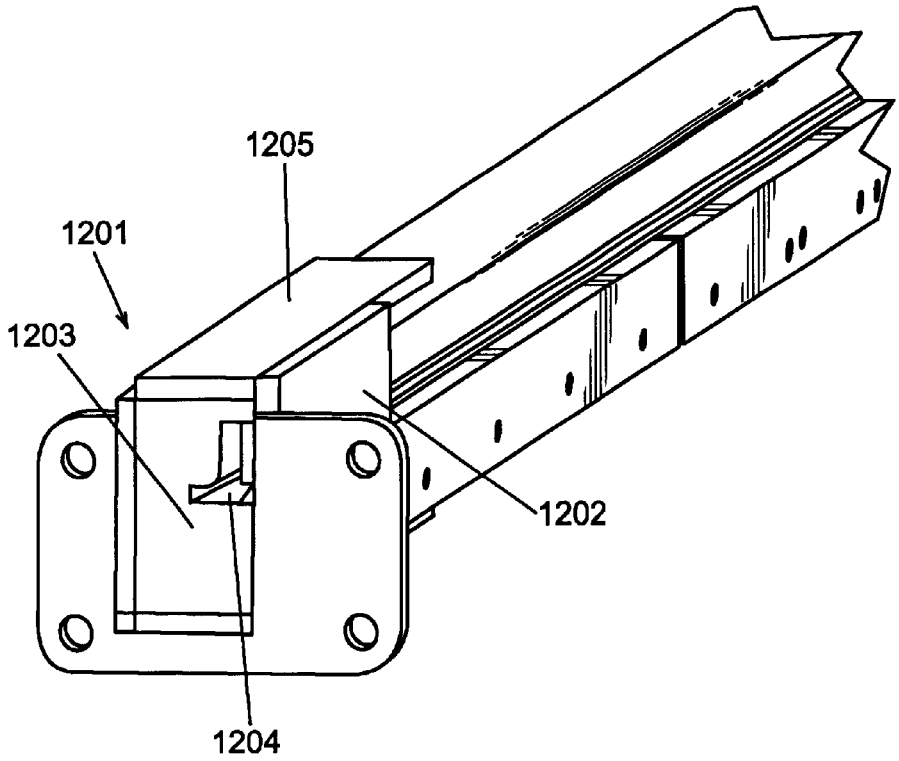
FIG. 12 illustrates an isometric view of the transition section of the transfer track.

FIGS. 9–14 provide a more detailed illustration of the track 107. As shown in FIG. 9, the track 107 has a horizontal section 108 that is located underneath the paper web and a turn-up portion 109 that curves upwardly so that the end of the turn-up portion is adjacent to the nip 204 (shown in FIG. 2). As shown in FIG. 12 at the beginning of the horizontal section 108 is a transition section 113.

FIGS. 10 and 11 illustrate the horizontal section 108 of the tape transfer track 107. The turn-up tape 301 travels on one of its narrow sides substantially vertical down the horizontal portion 108 in a groove 1001. The groove is formed by a sideways U-shaped aperture in the track 108 and a flexible seal 1005. The sideways U-shaped aperture is formed by a top wall 1002, a concave side wall 1003, and a bottom wall 1004 on which the turn-up tape 301 travels. The concave side wall 1003 is shaped such that when the front portion of the turn-up tape 301 with adhesive travels through the track, the adhesive does not adhere to the side wall 1003 and cause the turn-up tape to bind in the track. The groove 1001 in the horizontal portion 108 is shaped such that the turn-up tape does not bind or bunch up in the groove 1001 and can slide easily down the transfer track 108. The top portion 1002 along with the flexible seal 1005 prevent moisture and debris from entering the groove 1001. The flexible seal 1005 is kept in place by a clamp bar 1006 and a clamp bar fastener 1007. The flexible seal 1005 allows the turn-up tape 301 to be pulled out of the track across the entire length of the horizontal portion 108 when the turn-up tape 301 is drawn upward by the empty spool 204 while protecting the groove 1001 from debris and moisture from the environment.

Figure 13:
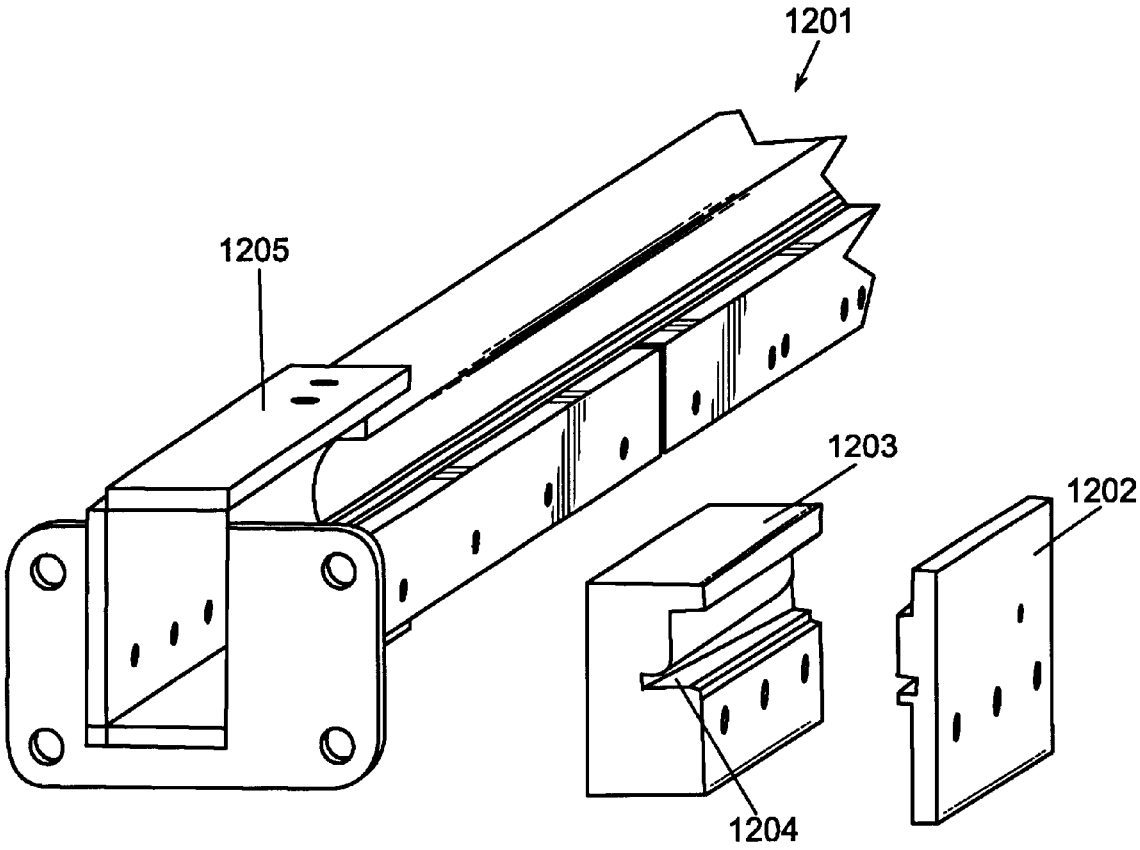
FIG. 13 illustrates the components of the transition section of the transfer track.

FIGS. 12 and 13 illustrate the transition section 1201. The transition section 1201 is attached to the front end of the horizontal portion 108. As shown in FIG. 12, the turn-up tape 301 enters the transition 1203 at opening 1204. As shown in FIG. 13, the tape 301 enters the transition 1203 at opening 1204 horizontally (with the wide side to the bottom of the track) and is gradually turned 90 degrees to be substantially vertical so it can travel along the horizontal section 108 as shown in FIGS. 10 and 11. A transition insert 1202 fits in the groove of the transition section 1201 and helps to keep the turn-up tape from kinking or bunching during the transition from horizontal to substantially vertical. The transition section 1201 is covered by a cover 1205 that connects the transition section 1201 to the horizontal section 108.

Figure 14:
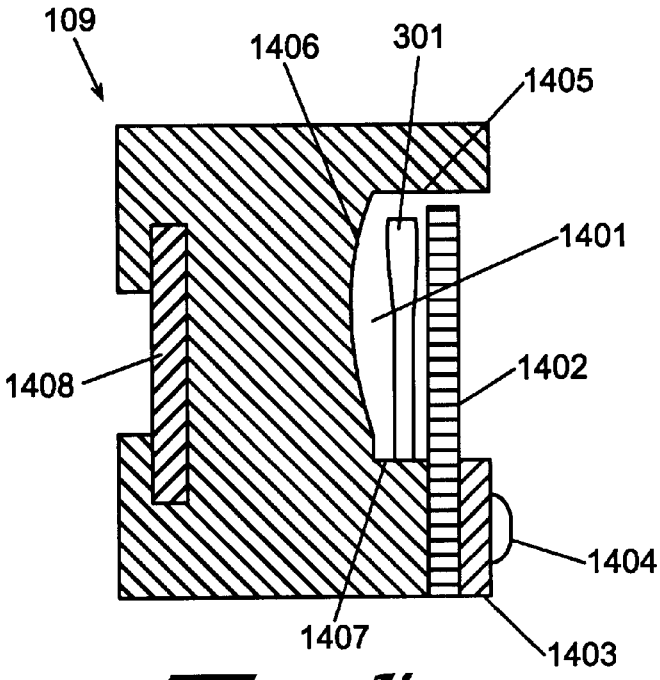
FIG. 14 illustrates a side view of the turn-up section of the transfer track.

FIG. 14 illustrates a sectional view of the turn-up section 109 of the transfer track 107. The tape 301 travels in the turn-up section 109 in much the same manner as the horizontal section 108. The tape 301 travels in a groove 1401 made of a U-shaped aperture in the transfer track and a urethane cover 1402. The U-shaped aperture is formed by a top wall 1405, a concave side wall 1406, and a bottom wall 1407. The turn-up tape 301 travels substantially perpendicular to the bottom wall 1407 in the direction of travel. The urethane cover 1402 keeps the tape 301 in the groove 1401 and keeps debris and moisture out of the groove 1401. The cover 1402 is held in place by a fastener bar 1403 and a fastener 1404. A track stiffener 1408 is placed on the opposite side of the transfer track as the groove 1401 to help stabilize the turn-up portion 109. As shown in FIGS. 2 and 9, the turn-up section 109 is slightly curved at the end so that the turn-up tape 301 may enter the nip 204 substantially horizontal.

The shape of the grooves in the transfer track 107 alleviates the twisting action that caused problems with the turn-up tape traveling through the transfer track and with extracting the turn-up tape from the transfer track in prior art machines.

Figure 15:
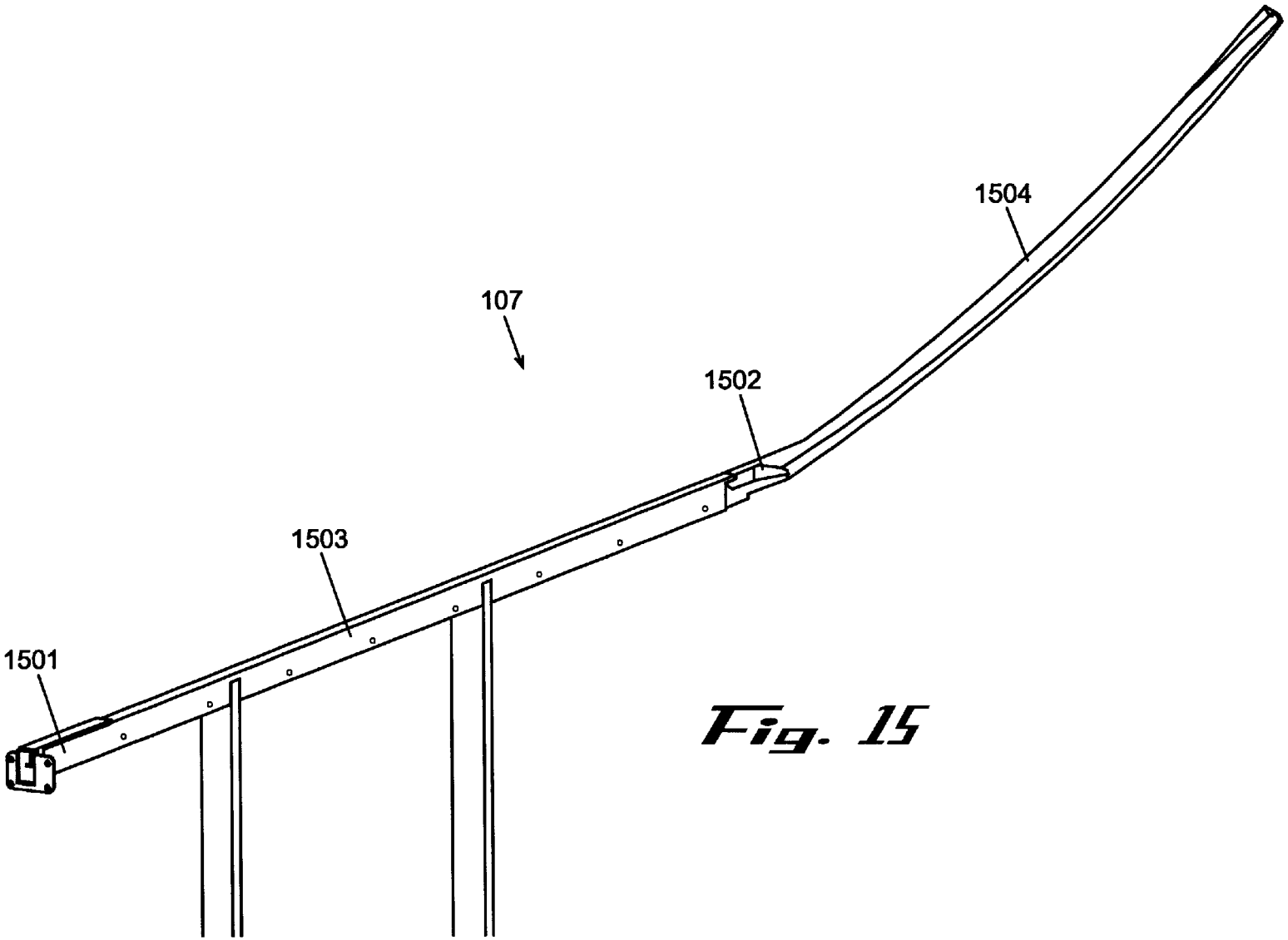
FIG. 15 illustrates an alternative embodiment of the transfer track.

FIGS. 15–20 provide a more detailed illustration of an alternative embodiment the tape transfer track 107. As shown in FIG. 15, the tape transfer track 107 has a horizontal section 1503 that is located underneath the paper web and a turn-up section 109. At the beginning of the horizontal section 1503 is a first transition section 1501 and at the end of the horizontal section 1503 before the turn-up section 1504 is a second transition section 1502.

Figure 16:
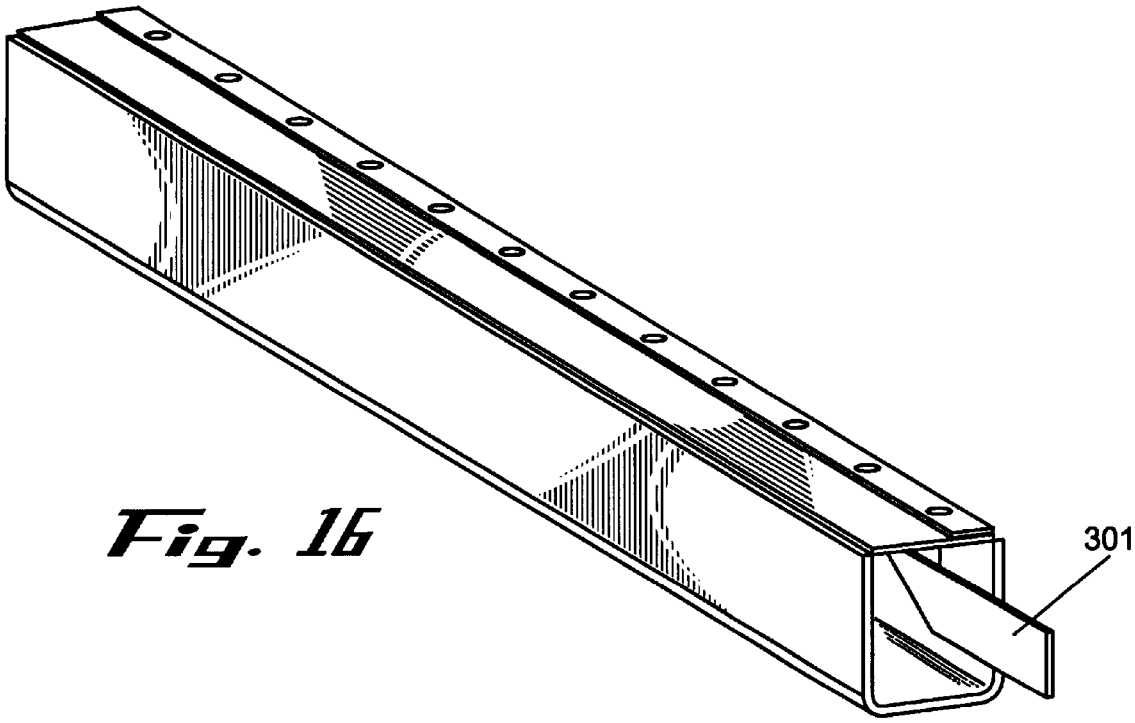
FIG. 16 illustrates an isometric view of an alternative embodiment of the horizontal section of the transfer track.
Figure 17:
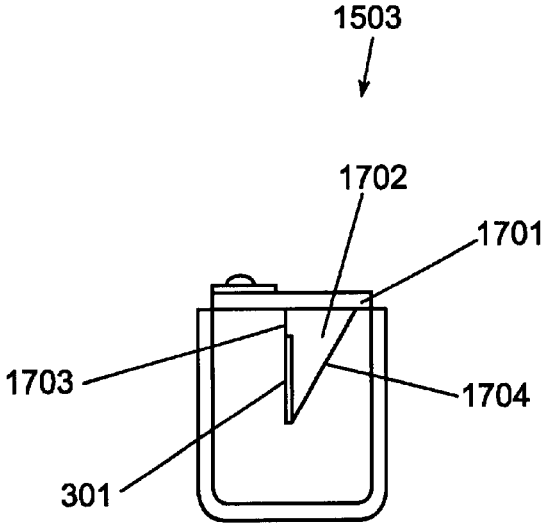
FIG. 17 illustrates a side view of an alternative embodiment of the horizontal section of the transfer track.

FIGS. 16 and 17 illustrate the horizontal section 1503 of the tape transfer track 107. Turning to FIG. 17, a V-shaped groove opening upwardly is formed in the horizontal section 1503. The V-shaped groove is formed by a substantially vertical side wall 1703 and a second side wall 1704 at an acute angle from the substantially vertical side wall 1703. The V-shaped groove 1702 is covered by a urethane seal 1701 on the top portion of the transfer track to prevent moisture and debris from entering the groove 1702. The urethane seal 1701 is attached to the transfer track in such a manner so as to allow the turn-up tape to be pulled out of the track across the entire length of the horizontal portion when the turn-up tape is drawn upward by the empty spool. The V-shaped groove 1702 provides for ease of evacuation of the turn-up tape 301 while allowing the turn-up tape 301 to slide easily down the horizontal section 1503 without any bunching or kinking problems.

Figure 18:
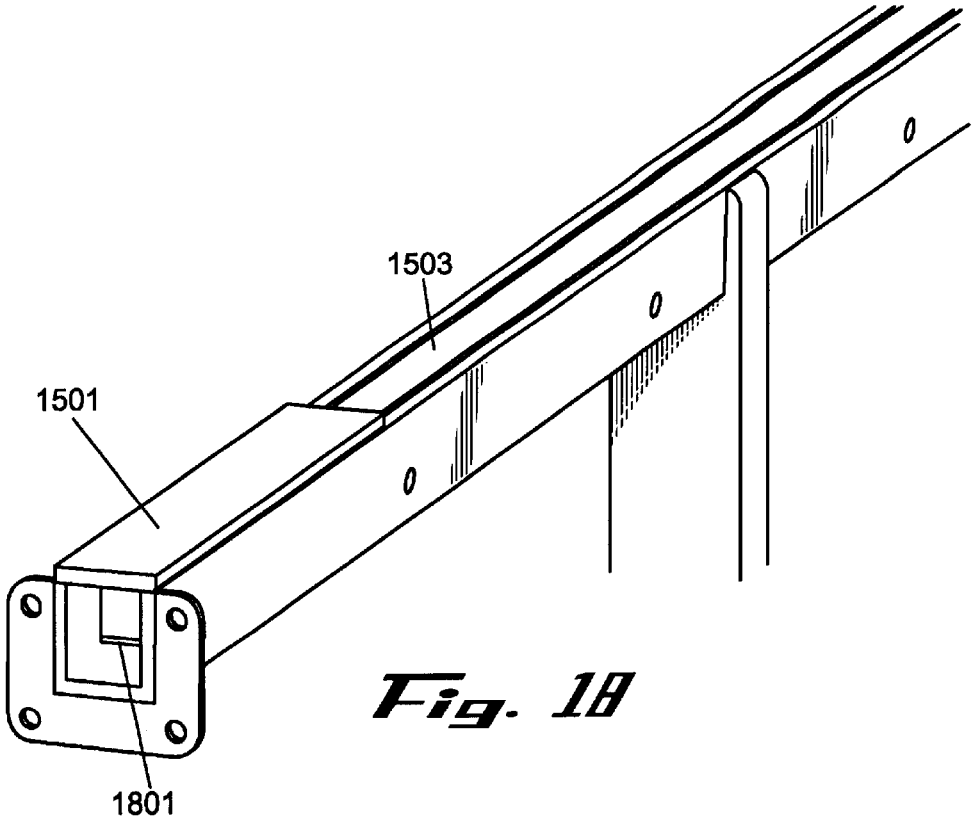
FIG. 18 illustrates an isometric view of the first transition section of an alternative embodiment of the transfer track.
Figure 19:
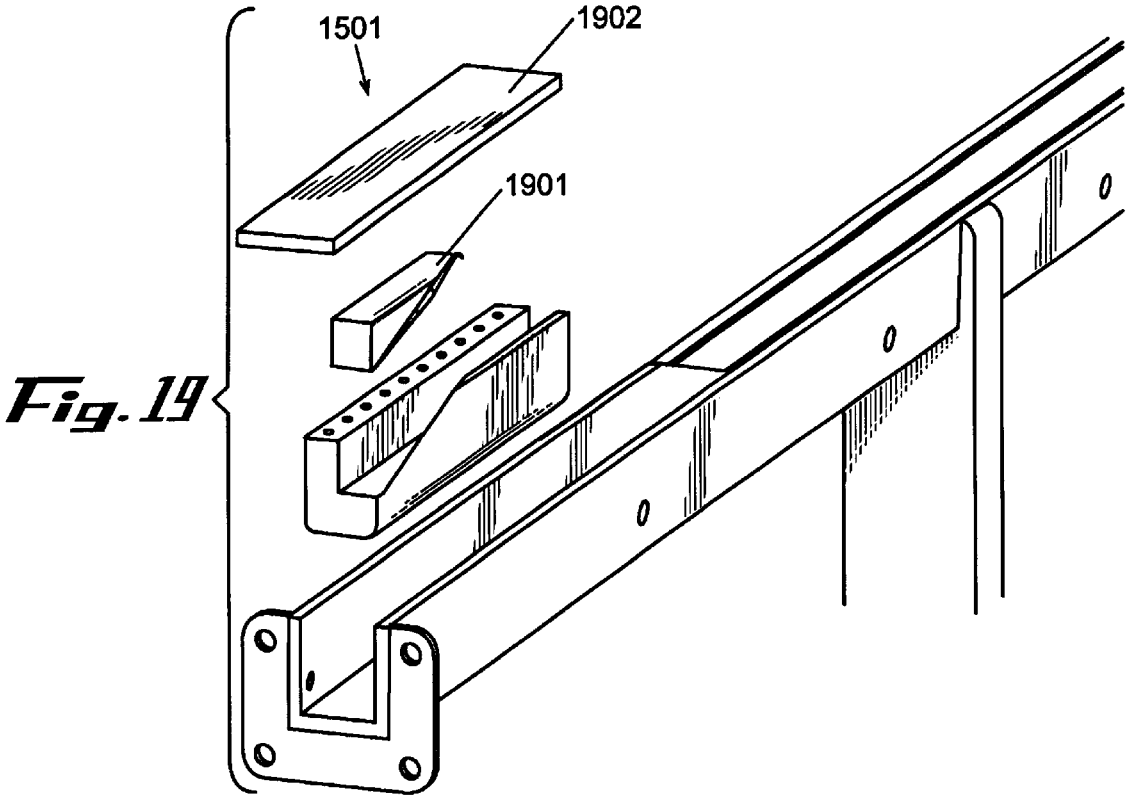
FIG. 19 illustrates the components of the first transition section of an alternative embodiment of the transfer track.

FIGS. 18 and 19 illustrate the first transition section 1501. As shown in FIG. 19, the first transition section 1501 begins at one end with a horizontal slot 1801 (shown in FIG. 18) and gradually slopes to the align with the second side wall 1704 of the V-shaped groove 1702. The slot 1801 is formed by a transition insert 1901 that fits into the first transition section and helps to keep the turn-up tape from kinking of bunching during the transition from the horizontal slot 1801 to the V-shaped groove 1702. The purpose of the first transition section is to provide a transition from the horizontal position of the turn-up tape to the V-shaped groove of the horizontal section 1503. The transition insert 1901 and first transition section 1501 are covered by an aluminum cover 1902 to help ensure that the turn-up tape stays in and to keep debris out of the first transition section 1501. In this embodiment, the first transition section 1501 is approximately ten inches in length.

Figure 20:
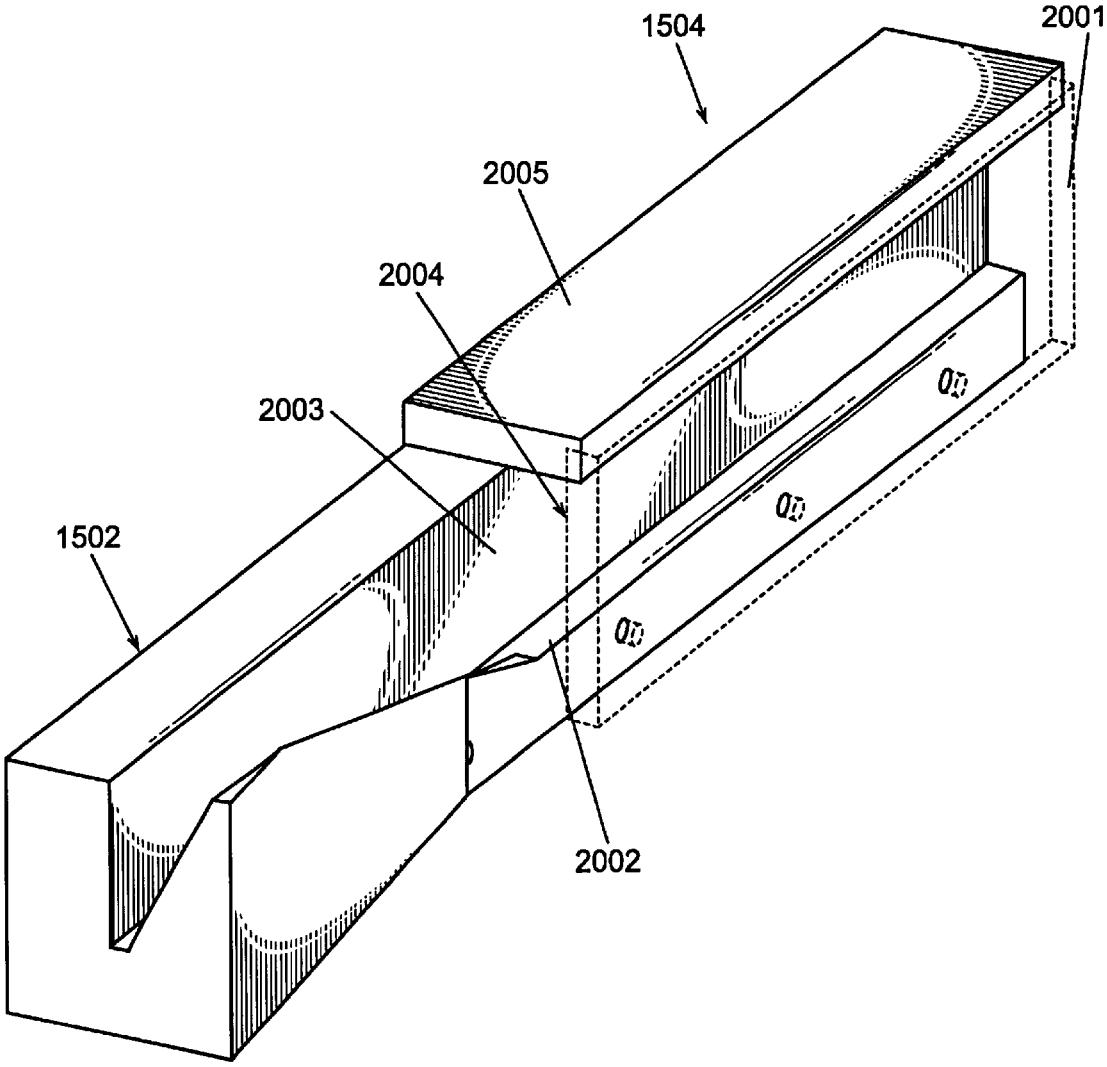
FIG. 20 illustrates an isometric view of the turn-up section and the second transition section of an alternative embodiment of the transfer track.

FIG. 20 illustrates the second transition section 1502 and the turn-up section 1504. As is shown in FIG. 20, the turn-up section 1504 has a U-shaped groove 2004 formed by a top wall 2005, a side wall 2003, and a bottom wall 2002. The turn-up tape travels substantially perpendicular to the bottom wall 2002 in the direction of travel. The U-shaped groove is enclosed by a second seal 2001.

Although not shown in FIG. 20, the second transition 1502 section is covered on the top by the top wall 2005 and on the side by the second seal 2001. The second transition section 1502 gradually transitions the V-shaped groove 1702 of the horizontal portion 1503 to the U-shaped groove of the turn-up portion 1504.

The urethane seal 1701 and the second seal 2001 prevent moisture and debris from entering the grooves and also keeps the turn-up tape in the grooves. The seals are attached to the track in such a manner so as to allow the turn-up tape to be pulled out of the track across the entire length of the transfer track 107 when the turn-up tape is drawn upward onto the empty spool 201. The use of the seals provides a solution to the problem of providing protection from the harmful environment of the paper mill.

The shape of the grooves in the transition sections combined with the shape of the grooves in the horizontal portion 1503 and the turn-up portion 1504 provide a smooth virtually twist free path for the turn-up tape. This virtually twist free path essentially alleviates the twisting action that caused problems with the,tape traveling through the track and with the extraction of the tape from the track in prior art machines The foregoing description of exemplary embodiments of the invention has been presented only for the purpose of illustration and description and is not intended to be exhaustive or to limit the invention to the precise forms disclosed. Many modifications and variations are possible in light of the above teaching. The embodiments were chosen and described in order to explain the principles of the invention and their practical applications so as to enable others skilled in the art to utilize the invention in various embodiments and with various modifications as are suited to the particular use contemplated.

What is claimed is:

1. An apparatus for cutting a traveling web of paper that is being wound onto a full spool and transferring the paper web onto an empty spool by feeding turn-up tape into a nip between the empty spool and the paper web, comprising:

a drive;

a transfer track for transporting the turn-up tape beneath the paper web and up to a position adjacent to the nip, the transfer track including, a horizontal section having a front end and a back end and a first groove running the length of the horizontal section, the first groove being defined by a first top wall, a first side wall, a first bottom wall, and a first flexible seal such that the turn-up tape travels substantially vertical in the direction of travel underneath the paper web; and a turn-up section connected to the back end of the horizontal section, the turn-up section being curved upwardly from the horizontal section to a position adjacent to the empty spool, and the turn-up section having a second groove running the length of the turn-up section, the second groove being defined by a second top wall, a second side wall, a second bottom wall, and a second flexible seal, the turn-up tape traveling substantially perpendicular to the second bottom wall, whereby the drive is capable of driving the turn-up tape to the end of the transfer track.

2. The apparatus of claim 1 further comprising a computer, whereby the operation of the drive is controlled by a computer.

3. The apparatus of claim 2 further comprising a looper bin assembly including, a looper bin capable of collecting turn-up tape;

a looper bin door located above the looper bin that has an open position and a closed position and controls the collection of turn-up tape by the looper bin, in the closed position the turn-up tape moves over the looper bin door horizontally in the direction of travel and in the open position the turn-up tape collects in to the looper bin;

a door attachment link pivotally connected to the looper bin door;

an air cylinder rod connected to the door attachment link, the air cylinder rod having an in position and an out position such that when the air cylinder rod is in the in position the looper bin door is in the closed position and when the air cylinder rod is in the out position the looper bin door is in the open position; and an air cylinder connected to the air cylinder rod, the air cylinder controlling whether the air cylinder rod is in the in position or the out position.

4. The apparatus of claim 3 wherein the operation of the looper bin assembly is controlled by the computer.

5. The apparatus of claim 1, further comprising a camming unit for moving the turn-up tape into the nip including:

an equal angle cam having a curved outside edge shaped like an equal angle spiral; and a roller, whereby the turn-up tape travels in between the equal angle cam and the roller, and the equal angle moves into contact with the turn-up tape and acts to clamp the turn-up tape against the roller and the equal angle cam rotates along the curved outside edge thereby moving the turn-up tape down the transfer track and into the nip.

6. The apparatus of claim 5, whereby the operation of the camming unit is controlled by a computer.

7. The transfer track of claim 1, further comprising a transition section having an input end and an output end, the output end connected to the front end of the horizontal section, the transition section formed such that the turn-up tape enters the input end horizontal in the direction of travel and leaves the output end substantially vertical in the direction of travel.

8. In the horizontal portion of claim 1, wherein the first side wall is concave and the second side wall is concave.

9. In an apparatus for cutting a continuous web of paper that is being wound onto a full spool and transferring the paper web on to an empty spool by feeding turn-up tape into a nip between the empty spool and the paper web, including a drive with a measurement roller, the drive drives the turn-up tape to the end of a transfer track to a position adjacent to the nip, a camming unit for moving the turn-up tape into the nip comprising:

an equal angle cam having a curved outside edge shaped like an equal angle spiral; and a roller, whereby the turn-up tape travels in between the equal angle cam and the roller, and the equal angle moves into contact with the turn-up tape and acts to clamp the turn-up tape against the roller and the equal angle cam rotates along the curved outside edge thereby moving the turn-up tape down the transfer track and into the nip.

10. In an apparatus for cutting a continuous web of paper that is being wound onto a full spool and transferring the paper web on to an empty spool by feeding turn-up tape into a nip between the empty spool and the paper web, including a drive with a measurement roller, the drive drives the turn-up tape to the end of a transfer track to a position adjacent to the nip, a camming unit for moving the turn-up tape into the nip comprising:

at least one actuator assembly;

a shaft attached to the actuator assembly;

an equal angle cam and rotatably attached to the shaft, the equal angle cam having a curved outside edge shaped like an equal angle spiral; and a roller, whereby the turn-up tape travels in between the equal angle cam and the roller and whereby the actuator moves the shaft toward the roller and causes the equal angle cam to clamp the turn-up tape against the roller and causes the equal angle cam to rotate along the curved outside edge thereby moving the turn-up tape down the transfer track and into the nip.

11. The camming assembly of claim 10, wherein the actuator assembly is controlled by a computer.

12. The camming assembly of claim 10, wherein the actuator assembly includes a piston and a piston rod and the piston rod is connected to the shaft.

13. The camming assembly of claim 10, wherein the equal angle cam has a slot on the inside of the outside curved edge portion and the camming assembly has a second pin that fits into the slot whereby the second pin and slot keep the equal angle cam in the correct position.

14. An apparatus for cutting a traveling web of paper that is being wound onto a full spool and transferring the paper web onto an empty spool by feeding turn-up tape into a nip between the empty spool and the paper web, comprising:

a drive;

a transfer track for transporting the turn-up tape beneath the paper and up to a position adjacent to the nip, the transfer track including, a horizontal section having a front end and a back end and a V-shaped groove running the length of the horizontal section, the V-shaped groove formed by a substantially vertical side wall and a second side wall at an acute angle from the substantially vertical side wall, the V-shaped groove being covered by a first flexible seal;

a first transition section having a first input end and a first output end, the output end connected to the front end of the horizontal section, the first transition section having a slot formed such that the slot is horizontal at the input end and gradually changes to align with the second side wall at the output end;

a turn-up section being curved upwardly from the horizontal section to a position adjacent to the empty spool, and the turn-up section having a U-shaped groove running the length of the turn-up section, the groove being defined by a top wall, a third side wall, and a bottom wall and enclosed by a second flexible seal, the turn-up tape traveling substantially perpendicular to the bottom wall; and a second transition section having a second input end and a second output end connected to the horizontal section at the second input end and connected to the turn-up section at the second output section, the second transition section having a third groove that gradually transitions from the V-shaped groove of the horizontal section to the U-shaped groove of the turn-up portion, whereby the drive is capable of driving the turn-up tape to the end of the transfer track.

15. In an apparatus for cutting a continuous web of paper that is being wound onto a full spool and transferring the paper web on to an empty spool by feeding turn-up tape into a nip between the empty spool and the paper web, including a drive and a transfer track, a method for moving the turn-up tape into the nip comprising:

rotating an equal angle cam in contact with the turn-up tape to move the tape down the transfer track and into the nip.

16. The method of claim 15 further comprising moving the equal angle cam toward a roller to clamp the turn-up tape against the roller before rotating the cam.

17. In an apparatus for cutting a continuous web of paper that is being wound onto a full spool and transferring the paper web on to an empty spool by feeding turn-up tape into a nip between the empty spool and the paper web, including a drive with a measurement roller, the drive drives the turn-up tape to the end of a transfer track to a position adjacent to the nip, a camming unit for moving the turn-up tape into the nip comprising:

an actuator assembly;

a clevis having two arms, the clevis being attached to the actuator assembly;

an equal angle cam positioned between the two arms of the clevis and rotatably attached to the two arms by a first pin, the equal angle cam having a curved outside edge shaped like an equal angle spiral; and a roller, whereby the turn-up tape travels in between the equal angle cam and the roller and whereby the actuator assembly moves the clevis and causes the equal angle cam to clamp the turn-up tape against the roller and causes the equal angle cam to rotate along the curved outside edge thereby moving the turn-up tape down the transfer track and into the nip.

* * * * *